US008226781B2

(12) United States Patent
Suzuki et al.

(10) Patent No.: US 8,226,781 B2
(45) **Date of Patent: *Jul. 24, 2012**

(54) HIGH STRENGTH ALUMINUM ALLOY FIN MATERIAL AND METHOD OF PRODUCTION OF SAME

(75) Inventors: Hideki Suzuki, Shizuoka (JP); Yoshito Oki, Shizuoka (JP); Tomohiro Sasaki, Shizuoka (JP); Masae Nagasawa, Shizuoka (JP)

(73) Assignee: Nippon Light Metal Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/207,950

(22) Filed: Aug. 11, 2011

(65) Prior Publication Data

US 2011/0293468 A1 Dec. 1, 2011

Related U.S. Application Data

(62) Division of application No. 11/996,836, filed on Jan. 25, 2008, now Pat. No. 7,998,288.

(30) Foreign Application Priority Data

Jul. 27, 2005 (JP) ..... 2005-216987

(51) Int. Cl.
*C22C 21/00* (2006.01)

(52) U.S. Cl. ..... 148/437; 148/549; 148/552; 148/696; 420/528; 420/540; 420/548; 420/550

(58) Field of Classification Search ..... 148/437, 148/549–552, 696; 420/528, 540, 548, 550
See application file for complete search history.

(56) References Cited

U.S. PATENT DOCUMENTS

| | | | |
|---|---|---|---|
| 6,579,387 | B1 | 6/2003 | Selepack et al. |
| 2003/0015573 | A1 | 1/2003 | Kawahara et al. |
| 2004/0028940 | A1 | 2/2004 | Toyama et al. |
| 2005/0106410 | A1 | 5/2005 | Jiang et al. |
| 2007/0113936 | A1 | 5/2007 | Oki et al. |

FOREIGN PATENT DOCUMENTS

| | | | |
|---|---|---|---|
| CA | 2553910 | A1 * | 8/2005 |
| GB | 2 390 099 | | 1/2005 |
| JP | 2000 144294 | | 5/2000 |
| JP | 2000 202681 | | 7/2000 |
| JP | 2002161323 | A * | 6/2002 |
| JP | 2004 176091 | | 6/2004 |
| JP | 2004176091 | A * | 6/2004 |
| JP | 2005 002383 | | 1/2005 |
| JP | 2005 060790 | | 3/2005 |
| WO | WO-03 054242 | | 7/2003 |
| WO | WO-2005 075691 | | 8/2005 |

OTHER PUBLICATIONS

Machine translation of JP 2002161323 A.*
Machine translation of JP 2004176091 A.*
Machine translation of JP 2002161323 A. Generated Apr. 5, 2010. Source document date Apr. 6, 2002.*
Machine translation of JP JP 2004176091 A. Generated no later than Oct. 25, 2011. Source document date Jun. 4, 2004.*
English language machine translation of JP-2005 002383, Generated Dec. 17, 2009.
Kobe Steel Ltd., "Aluminum alloy sheet excellent in press formability and hem workability," Publication Date: May 26, 2000; English Abstract of JP-2000 144294.
Mitsubishi Alum Co Ltd., "High Strength aluminum alloy fin material for automotive heat exchanger having excellent rollability and its manufacturing method," Patent Abstracts of Japan, Publication Date: Jun. 24, 2004; English Abstract of JP-2004 176091.
Office Action for Corresponding Japanese Patent Application dated Feb. 16, 2011.
Sumitomo Light Metal Ind Ltd., "Aluminum alloy fin material for heat exchanger excellent in brazability," Patent Abstracts of Japan, Publication Date: Jul. 25, 2000; English Abstract of JP-2000 202681.
Sumitomo Light Metal Industries, "Aluminum alloy brazing fin material for heat exchanger," Publication Date: Mar. 10, 2005; English Abstract of JP-2005 060790.

* cited by examiner

*Primary Examiner* — Stanley Silverman
*Assistant Examiner* — Brian Walck
(74) *Attorney, Agent, or Firm* — Millen, White, Zelano & Branigan, P.C.

(57) ABSTRACT

A heat exchanger use high strength aluminum alloy fin material having a high strength and excellent in thermal conductivity, elusion resistance, sag resistance, sacrificial anodization effect, and self corrosion resistance, characterized by containing Si: 0.8 to 1.4 wt %, Fe: 0.15 to 0.7 wt %, Mn: 1.5 to 3.0 wt %, and Zn: 0.5 to 2.5 wt %, limiting the Mg as an impurity to 0.05 wt % or less, and having a balance of ordinary impurities and Al in chemical composition, having a metal structure before brazing of a fibrous crystal grain structure, a tensile strength before brazing of not more than 240 MPa, a tensile strength after brazing of not less than 150 MPa, and a recrystallized grain size after brazing of 500 μm or more.

4 Claims, No Drawings

HIGH STRENGTH ALUMINUM ALLOY FIN MATERIAL AND METHOD OF PRODUCTION OF SAME

This application is a divisional of U.S. patent application Ser. No. 11/996,836, filed Jan. 25, 2008 now U.S. Pat. No. 7,998,288, which is incorporated by reference herein.

TECHNICAL FIELD

The present invention relates to a heat exchanger use aluminum alloy fin material excellent in brazeability and a method of production of the same, more particularly relates to an aluminum alloy fin material used for a heat exchanger such as a radiator, car heater, car air-conditioner, etc. where fins and a working fluid passage material are brazed together, in which heat exchanger aluminum alloy fin material the strength before brazing is suitable, so fin forming is easy, that is, the strength before brazing is not too high making fin forming difficult, the strength after brazing is high, and the thermal conductivity, erosion resistance, sag resistance, sacrificial anodization effect, and self corrosion resistance are excellent, and a method of production of the same.

BACKGROUND ART

An automobile radiator, air conditioner, intercooler, oil cooler, or other heat exchanger is assembled by brazing together a working fluid passage material comprised of an Al—Cu-based alloy, Al—Mn-based alloy, Al—Mn—Cu-based alloy, etc. and fins comprised of an Al—Mn-based alloy etc. The fin material is required to have a sacrificial anodization effect in order to prevent corrosion of the working fluid passage material and is required to have an excellent sag resistance and erosion resistance in order to prevent deformation or erosion of the brazing material due to the high temperature heating at the time of brazing.

JIS 3003, JIS 3203, and other Al—Mn-based aluminum alloys are used as fin materials because Mn effectively acts to prevent deformation or erosion of the brazing material at the time of brazing. An Al—Mn-based alloy fin material may be given a sacrificial anodization effect by the method of adding Zn, Sn, In, etc. to this alloy to make it electrochemically anodic (Japanese Patent Publication (A) No. 62-120455) etc. To further improve the high temperature buckling resistance (sag resistance), there is the method of introducing Cr, Ti, Zr, etc. into the Al—Mn-based alloy (Japanese Patent Publication (A) No. 50-118919) etc.

However, recently, heat exchangers are increasingly being required to be made lighter in weight and lower in cost. The working fluid passage material, fin material, and other heat exchanger materials are increasingly being required to be made thinner. However, if for example making the fins thinner, the heat conduction sectional area becomes smaller, so the heat exchange performance falls and final product heat exchanger has problems in strength and durability. Therefore, a much higher heat conduction performance, strength after brazing, sag resistance, erosion resistance, and self corrosion resistance are desirable.

In conventional Al—Mn-based alloys, the Mn dissolves into the matrix due to the heat at the time of brazing, so there is the problem that the thermal conductivity falls. As a material for solving this difficulty, an aluminum alloy limiting the Mn content to not more than 0.8 wt % and containing Zr: 0.02 to 0.2 wt % and Si; 0.1 to 0.8 wt % has been proposed (Japanese Patent Publication (82) No. 63-23260). This alloy has an improved thermal conductivity, but the amount of Mn is small, so the strength after brazing is insufficient and the fins easily collapse or deform during use as a heat exchanger. Further, the potential is not sufficiently anodic, so the sacrificial anodization effect is small.

On the other hand, by speeding up the cooling rate when casting an aluminum alloy melt into a slab, even if making the Si and Mn contents etc. 0.05 to 1.5 mass %, the intermetallic compounds crystallizing at the slab casting can be reduced in size to a maximum size of not more than 5 μm. It has been proposed to improve the fatigue properties of the fin material by rolling this slab (Japanese Patent Publication (A) No. 2001-226730). However, this invention has as its object the improvement of the fatigue life. While it describes making the cast slab thinner etc. as means for speeding up the cooling rate when casting the slab, no specific disclosure such as thin slab continuous casting by a twin-belt casting machine in industrial scale operations can be found.

DISCLOSURE OF THE INVENTION

An object of the present invention is to provide a heat exchanger use aluminum alloy fin material having suitable strength before brazing enabling easy fin forming, having high strength after brazing as well, and having excellent sag resistance, erosion resistance, self corrosion resistance, and sacrificial anodization and a method of production of the same.

To achieve the object, the heat exchanger use high strength aluminum alloy fin material of the present invention is characterized by containing Si: 0.8 to 1.4 wt %, Fe: 0.15 to 0.7 wt %, Mn: 1.5 to 3.0 wt %, and Zn: 0.5 to 2.5 wt %, limiting the Mg as an impurity to 0.05 wt % or less, and having a balance of ordinary impurities and Al in chemical composition, having a metal structure before brazing of a fibrous crystal grain structure, a tensile strength before brazing of not more than 240 MPa, a tensile strength after brazing of not less than 150 MPa, and a recrystallized grain size after brazing of 500 μm or more.

A first method of producing a heat exchanger use high strength aluminum alloy fin material of the present invention is characterized by casting a melt having the chemical composition of the fin material to continuously cast and coil into a roll a thin slab having a thickness of 5 to 10 mm by a twin-belt casting machine, cold rolling this slab to a sheet thickness of 1.0 to 6.0 mm, treating this sheet by primary intermediate annealing at 200 to 350° C., further cold rolling the sheet to a sheet thickness 0.05 to 0.4 mm, treating the sheet by secondary intermediate annealing at 360 to 450° C., and cold rolling the sheet by a final cold rolling rate of 10% to less than 50% to a final sheet thickness 40 to 200 μm.

A second method of producing a heat exchanger use high strength aluminum alloy fin material of the present invention is characterized by casting a melt having the chemical composition of the fin material to continuously cast and coil into a roll a thin slab having a thickness of 5 to 10 mm by a twin-belt casting machine, cold rolling this slab to a sheet thickness of 1.0 to 6.0 mm, treating this sheet by primary intermediate annealing at 200 to 450° C., further cold rolling the sheet to a sheet thickness 0.08 to 2.0 mm, treating the sheet by secondary intermediate annealing at 360 to 450° C., cold rolling the sheet by a cold rolling rate of 50% to 96% to a final sheet thickness 40 to 200 μm, and treating the sheet by final annealing at 200 to 400° C.

In the first and second methods, the primary intermediate annealing is preferably performed by a continuous annealing furnace with a rate of temperature rise of 100'C/rain or more and with a holding temperature of 400 to 500° C. and a holding time of within 5 minutes.

In the first and second methods, in the stages of after the primary intermediate annealing, after the secondary intermediate annealing, and after the final annealing (before the brazing), the metal structure is preferably a fibrous crystal grain structure.

According to the present invention, by limiting the chemical composition and the crystal grain structure and tensile strength before and after brazing in this way, a heat exchanger use high strength aluminum alloy fin material having a high strength and excellent in thermal conductivity, erosion resistance, sag resistance, sacrificial anodization effect, and self corrosion resistance is obtained. This aluminum alloy fin material may be produced by the first and the second method.

BEST MODE FOR CARRYING OUT THE INVENTION

The inventors worked to develop an aluminum alloy fin material satisfying the requirement of the reduction of thickness of heat exchanger use fin materials by comparing rolled materials from conventional DC slab casting lines and rolled materials from twin-belt continuous casting lines for the strength properties, thermal conductivity, sag resistance, erosion resistance, self corrosion resistance, and sacrificial anodization effect and studying the relationships among the compositions, intermediate annealing conditions, reduction rates, and final annealing in various manners and thereby completed the present invention.

The meanings and reasons for limitation of the alloy ingredients of the heat exchanger use aluminum alloy fin material of the present invention will be explained below.

[Si: 0.8 to 1.4 wt %]

Si, in the copresence of Fe and Mn, forms submicron level. Al—(Fe.Mn)—Si-based compounds at the time of brazing so as to improve the strength, simultaneously reduce the amount of solute Mn, and improve the thermal conductivity. If the content of Si is less than 0.8 wt %, the effect is insufficient, while if over 1.4 wt %, the fin material is liable to melt at the time of brazing. Therefore, the preferable range of content is 0.8 to 1.4 wt %. The more preferable content of Si is 0.9 to 1.4 wt % in range.

[Fe: 0.15 to 0.7 wt %]

Fe, in the copresence of Mn and Si, forms submicron level Al—(Fe.Mn)—Si-based compounds at the time of brazing so as to improve the strength, simultaneously reduce the amount of solute Mn, and improve the thermal conductivity. If the content of Fe is less 0.15 wt %, high purity metal would be required, so the production costs would become higher, so this is not preferred. If over 0.7 wt %, at the time of casting the alloy, coarse Al—(Fe.Mn)—Si-based crystals are formed and the sheet material becomes difficult to produce. Therefore, the preferable range is 0.15 to 0.7 wt %. The more preferable content of Fe is 0.17 to 0.6 wt % in range.

[Mn: 1.5 to 3.0 wt %]

Mn, in the copresence of Fe and Si, precipitates at a high density as submicron level Al—(Fe.Mn)—Si-based compounds at the time of brazing and improves the strength of the alloy material after brazing. Further, the submicron level Al—(Fe.Mr)—Si-based crystals have a strong action in inhibiting recrystallization, so the recrystallized grains become coarse ones of 500 μm or more size and the sag resistance and erosion resistance are improved. If Mn is less than 1.5 wt %, its effect is not sufficient, while if over 3.0 wt %, coarse Al—(Fe.Mn)—Si-based crystals are formed at the time of casting of the alloy and the sheet material becomes difficult to produce. Also, the amount of solute Mn increases and the thermal conductivity falls. Therefore, the preferable range of content is 1.5 to 3.0 wt %. The more preferable content of Mn is 1.6 to 2.8 wt %.

[Zn: 0.5 to 2.5 wt %]

Zn makes the potential of the fin material anodic to give a sacrificial anodization effect. If the content is less than 0.5 wt %, its effect is not sufficient, while if over 2.5 wt %, the self corrosion resistance of the material deteriorates. Further, due to the dissolution of the Zn, the thermal conductivity falls. Therefore, the preferable range of content is 0.5 to 2.5 wt %. The more preferable content of Zn is 1.0 to 2.0 wt % in range.

[Mg: 0.05 wt % or less]

Mg has an effect on the brazeability. If the content is over 0.05 wt %, the brazeability is liable to be harmed. In particular, when brazing using a fluoride-based flux, the flux ingredient fluorine (F) and the Mg in the alloy easily react whereupon $MgF_2$ or other compounds are produced. Due to this, the absolute amount of flux effectively acting at the time of brazing becomes insufficient and brazing defects easily occur. Therefore, the content of Mg as an impurity is limited to not more than 0.05 wt %.

Regarding the impurity ingredients other than Mg, Cu makes the potential of the material cathodic, so is preferably limited to not more than 0.2 wt %. Cr, Zr, Ti, and V remarkably reduce the thermal conductivity of the material even in small amounts, so the total content of these elements is preferably limited to not more than 0.20 wt %.

Next, the meanings and reasons for limitation of the casting conditions of the thin slab, the intermediate annealing conditions, the final cold rolling rate, and the final annealing conditions in the present invention will be explained.

[Casting Conditions of Thin Slab]

The twin-belt casting method is a continuous casting method casting a melt between rotating belts facing each other in the vertical direction and water cooled so as to solidify the melt by cooling from the belt surfaces and cast a slab and continuously pulling out and coiling the slab from the opposite sides of the belts. In the present invention, the thickness of the cast slab is preferably 5 to 10 mm. If the thickness is in this range, the solidification rate at the center of the sheet thickness is also fast, the structure becomes uniform, and, if the composition is in the range of the present invention, there are little coarse compounds formed, and, after brazing, a fin material having a large crystal grain size and excellent properties can be obtained.

If the thickness of the thin slab from the twin-belt casting machine is less than 5 mm, the amount of aluminum passing through the casting machine per unit time becomes too small and the casting becomes difficult. Conversely, if the thickness is over 10 mm, the sheet can no longer be coiled up by the roll. Therefore, the slab thickness preferably is in the range of 5 to 10 mm.

Note that the casting speed at the time of solidification of the melt is preferably 5 to 15 m/min. The solidification preferably is completed in the belts. If the casting speed is less than 5 m/min, the casting takes too much time and the productivity falls, so this is not preferred. If the casting speed is over 15 m/min, the aluminum melt cannot be supplied fast enough and obtaining the predetermined shape of a thin slab becomes difficult.

[Primary Intermediate Annealing Conditions]

When keeping down the strength of the final product by making the final cold rolling rate 10 to less than 50% (second embodiment), the holding temperature of the primary intermediate annealing is preferably 200 to 350° C. If the holding temperature of the primary intermediate annealing is less than 200° C., a sufficient softened state cannot be obtained. If the holding temperature of the primary intermediate annealing is over 350° C., the solute Mn in the matrix ends up precipitating as an Al—(Fe.Mn)—Si-based compound at the time of intermediate annealing at a high temperature, so the material ends up recrystallizing at the time of the secondary intermediate annealing. If the subsequent final cold rolling rate is a low 10 to less than 50%, at the time of brazing, the material ends up remaining in the not yet recrystallized state and the sag resistance and erosion resistance at the time of brazing fall.

If the final cold rolling rate is a high 50 to 96%, it is critical to apply final annealing so as to keep down the strength of the final product. In this case (third embodiment), a holding temperature of the primary intermediate annealing is preferably 200 to 450° C. If the holding temperature of the primary intermediate annealing is less than 200° C., a sufficient softened state cannot be obtained. If the holding temperature of the primary intermediate annealing is over 350° C., the solute Mn in the matrix ends up precipitating as an Al—(Fe.Mn)—Si-based compound at the time of intermediate annealing at a high temperature, but since the final cold rolling rate is high, the cold rolling rate before the secondary intermediate annealing is low, so the dislocation density is low and recrystallization does not occur at the time of secondary intermediate annealing. However, if the holding temperature of the primary intermediate annealing is over 450° C., the solute Mn in the matrix ends up precipitating in a large amount and coarse size as an Al—(Fe.Mn)—Si-based compound at the time of intermediate annealing at a high temperature, so not only does the material recrystallize at the time of the secondary intermediate annealing, but also the action in inhibiting recrystallization at the time of brazing becomes weaker, the recrystallized grain size becomes less than 500 μm, and the sag resistance and erosion resistance at the time of brazing fall.

The holding time of the primary intermediate annealing does not have to be particularly limited, but 1 to 5 hours in range is preferable. If the holding time of the primary intermediate annealing is less than 1 hour, the temperature of the coil as a whole remains uneven and a uniform recrystallized structure may not be able to be obtained in the sheet, so this is not preferred. If the holding time of the primary intermediate annealing is over 5 hours, the solute Mn progressively precipitates. Not only is this disadvantageous in stably securing a recrystallized grain size after brazing of 500 μm or more, but also the treatment takes too much time and the productivity falls, so this is not preferred.

The rate of temperature rise and cooling rate at the time of primary intermediate annealing do not have to be particularly limited, but at least 30° C./hour is preferable. If the rate of temperature rise and cooling rate at the time of primary intermediate annealing is less than 30° C./hour, the solute Mn progressively precipitates. Not only is this disadvantageous in stably securing a recrystallized grain size after brazing of 500 or more, but also the treatment takes too much time and the productivity falls, so this is not preferred.

The temperature of the first intermediate annealing in the continuous annealing furnace is preferably 400 to 500° C. If less than 400° C., a sufficient softened state cannot be obtained. However, if the holding temperature exceeds 500° C., the solute Mn in the matrix ends up precipitating as a coarse Al—(Fe.Mn)—Si-based compound at the time of intermediate annealing at a high temperature, so the action in inhibiting recrystallization at the time of secondary intermediate annealing or at the time of brazing becomes weaker, the recrystallized grain size becomes less than 500 μm, and the sag resistance and erosion resistance at the time of brazing fall.

The holding time of the continuous annealing is preferably within 5 minutes. If the holding time of the continuous annealing is over 5 minutes, the solute Mn progressively precipitates. Not only is this disadvantageous in stably securing a recrystallized grain size after brazing of 500 μm or more, but also the treatment takes too much time and the productivity falls, so this is not preferred.

Regarding the rate of temperature rise and cooling rate at the time of the continuous annealing, the rate of temperature rise is preferably at least 100° C./min. If the rate of temperature rise at the time of the continuous annealing is less than 100° C./min, the treatment takes too much time and the productivity falls, so this is not preferred.

[Secondary Intermediate Annealing Conditions]

The holding temperature of the secondary intermediate annealing is preferably 360 to 450° C. If the holding temperature of the secondary intermediate annealing is less than 360° C., a sufficient softened state cannot be obtained. However, if the holding temperature of the secondary intermediate annealing is over 450° C., the solute Mn in the matrix ends up coarsely precipitating as an Al—(Fe.Mn)—Si-based compound at the time of intermediate annealing at a high temperature and a recrystallized structure ends up being formed, so the action in inhibiting recrystallization at the time of brazing becomes weaker, the recrystallized grain size becomes less than 500 μm, and the sag resistance and erosion resistance at the time of brazing fall.

The holding time of the secondary intermediate annealing does not have to be particularly limited, but 1 to 0.5 hours in range is preferable. If the holding time of the secondary intermediate annealing is less than 1 hour, the temperature of the coil as a whole remains uneven and there is a possibility that a uniform structure will not be able to be obtained in the sheet, so this is not preferred. If the holding time of the secondary intermediate annealing exceeds 5 hours, the solute Mn progressively precipitates. Not only is this disadvantageous in securing a recrystallized grain size after brazing of 500 μm or more, but also the treatment takes too much time and the productivity falls, so this is not preferred.

The rate of temperature rise and cooling rate of the secondary intermediate annealing do not have to be particularly limited, but at least 30° C./hour is preferable. If the rate of temperature rise and cooling rate at the time of the secondary intermediate annealing are less than 30° C./hour, the solute Mn progressively precipitates. Not only is this disadvantageous in securing a recrystallized grain size after brazing of 500 μm or more, but also the treatment takes too much time and the productivity falls, so this is not preferred.

[Fibrous Crystal Grain Structure]

Making the metal structure a fibrous crystal grain structure at any stage after the primary intermediate annealing, after the secondary intermediate annealing, or after the final annealing (before the brazing) means making the metal structure a fibrous crystal grain structure not containing any crystal grain structure of 200 μm or more size at any stage.

[Final Cold Rolling Rate]

The final cold rolling rate is preferably 10 to 96%. If the final cold rolling rate is less than 10%, the strain energy accumulated in the cold rolling is small and recrystallization does not become completed in the process of raising the temperature at the time of brazing, so the sag resistance and the erosion resistance fall. If the final cold rolling rate exceeds 96%, edge cracks at the time of rolling become remarkable, and the yield falls. If not performing the final annealing, if the final cold rolling rate exceeds 50%, the final product becomes too high in strength and it becomes difficult to obtain a predetermined fin shape at the time of forming the fin material. On the other hand, if the final cold rolling rate is 50% or more, depending on the composition, the final product becomes too high in strength and a predetermined fin shape becomes difficult to obtain at the time of fin formation, but at this time, the various properties are not impaired even if subjecting the final cold rolled sheet to final annealing (softening) of a holding temperature of 200 to 400° C. for 1 to 3 hours. In particular, a fin material obtained by primary intermediate annealing of a sheet by a continuous annealing furnace, then final cold rolling, and then further final annealing (softening) at a holding temperature of 200 to 400° C. for 1 to 3 hours is excellent in fin formability, is high in strength after brazing, and is excellent in sag resistance.

The fin material of the present invention is slit to predetermined widths, corrugated, alternately stacked with flat pipes made of the working fluid passage material, for example, clad sheet comprised of 3003 alloy covered with a brazing material, and brazed together with them to obtain a heat exchanger unit.

According to the method of the present invention, at the time of casting of a thin slab by a twin-belt casting machine, the Al—(Fe.Mn)—Si-based compound uniformly and finely crystallizes in the slab, while the Mn and Si in supersaturated solid solution in the matrix phase Al precipitate at a high density as a submicron level Al—(Fe.Mn)—Si phase due to the high temperature heating at the time of brazing. Due to this, the amount of solute Mn in the matrix, which greatly reduces the heat conductivity, becomes smaller, so the electrical conductivity after brazing becomes higher and an excellent thermal conductivity is exhibited. Further, for similar reasons, the finely crystallized Al—(Fe.Mn)—Si-based compound and high density precipitated submicron level Al—(Fe.Mn)—Si phase inhibit dislocation movement at the time of plastic deformation, so the final-sheet after brazing exhibits a high tensile strength. Further, the submicron level Al—(Fe.Mn)—Si phase precipitating at the time of brazing has a strong recrystallization inhibiting action, so the recrystallized grain size after brazing becomes 500 μm or more, so the sag resistance becomes good. For similar reasons, an excellent erosion resistance is exhibited after brazing. Further, in the present invention, the content of Mn is limited to at least 1.5 wt %, so even if the average particle size of the recrystallized grains after brazing exceeds 3000 the tensile strength will not drop.

Further, a twin-belt casting machine is fast in the solidification rate of the melt, so the Al—(Fe.Mn)—Si-based compound crystallizing in a thin slab becomes uniform and fine. Therefore, in the final fin material, there are no longer secondary phase particles of circle equivalent diameters of 5 μm or more derived from coarse crystals and an excellent self corrosion resistance is exhibited.

By casting in this way by the twin-belt continuous casting method, the Al—(Fe.Mn)—Si compound in the slab is made uniform and fine and the submicron level Al—(Fe.Mn)—Si phase precipitate after brazing is made high in density. Further, by making the crystal grain size after brazing 500 μm or more, the strength after brazing, thermal conductivity, sag resistance, erosion resistance, and self corrosion resistance are improved. Simultaneously, by introducing Zn, the potential of the material is made anodic and the sacrificial anodization effect is made excellent. Therefore, it is possible to obtain a heat exchanger use aluminum alloy fin material having excellent durability.

EXAMPLES

Below, examples of the present invention will be explained in comparison with comparative examples. As the invention examples and comparative examples, alloys of the compositions of Alloy Nos. 1 to 12 shown in Table 1 were melted, run through ceramic filters, and poured into twin-belt casting molds to continuously cast slabs of thicknesses of 7 mm at a casting speed of 8 m/min. The cooling rates of the melts at the time of solidification were 50° C./sec. The thin slabs were cold rolled to the sheet thicknesses shown in Tables 2 to 4 (I/A1 sheet thickness). After this, the samples were inserted into an annealer, raised in temperature at a rate of temperature rise of 50° C./hr, held at the temperatures shown in Tables 2 to 4 for 2 hours, then cooled by cooling rates of 50° C./hr down to 100° C. or else the samples were held at a 450° C. salt bath for 15 seconds, then quenched in water as primary intermediate annealing. Next, the samples were cold rolled to the sheet thicknesses shown in Tables 2 to 4 (I/A2 sheet thickness), then inserted into an annealer, raised in temperature at a rate of temperature rise of 50° C./hr, held at the temperatures shown in Tables 2 to 4, then cooled by cooling rates of 50° C./hr down to 100° C. as secondary intermediate annealing. Next, the samples were cooled rolled at the final cold rolling rates shown in Tables 2 to 4 to obtain fin materials of a thickness of 60 μm. For parts of these samples, the samples were further inserted into an annealer, raised in temperature at a rate of temperature rise of 50° C./hr, held at the temperatures shown in Table 4 for 2 hr, then were cooled at a cooling rate of 50° C./hr down to 100° C. as final annealing.

TABLE 1

| Alloy Compositions (wt %) | | | | | | | |
|---|---|---|---|---|---|---|---|
| Alloy no. | Si | Fe | Cu | Mn | Mg | Zn | Ti |
| 1 | 1.20 | 0.30 | 0.02 | 2.40 | <0.02 | 1.90 | 0.01 |
| 2 | 1.20 | 0.45 | 0.02 | 2.40 | <0.02 | 1.90 | 0.01 |
| 3 | 1.20 | 0.30 | 0.02 | 1.90 | <0.02 | 1.90 | 0.01 |
| 4 | 1.20 | 0.30 | 0.02 | 2.10 | <0.02 | 1.90 | 0.01 |
| 5 | 1.20 | 0.45 | 0.02 | 1.70 | <0.02 | 1.90 | 0.01 |
| 6 | 0.88 | 0.52 | 0.00 | 1.10 | <0.02 | 1.46 | 0.01 |
| 7 | 1.20 | 0.55 | 0.02 | 3.30 | <0.02 | 1.72 | 0.01 |
| 8 | 0.60 | 0.20 | 0.02 | 2.40 | <0.02 | 1.50 | 0.01 |
| 9 | 1.50 | 0.20 | 0.02 | 2.20 | <0.02 | 1.50 | 0.01 |
| 10 | 1.10 | 0.90 | 0.02 | 2.40 | <0.02 | 1.52 | 0.01 |
| 11 | 1.00 | 0.30 | 0.02 | 2.50 | <0.02 | 0.20 | 0.01 |
| 12 | 1.20 | 0.35 | 0.02 | 2.40 | <0.02 | 2.90 | 0.01 |
| 13 | 0.83 | 0.54 | 0.01 | 1.16 | 0.018 | 1.45 | 0.02 |
| 14 | 0.30 | 0.53 | 0.02 | 1.02 | 0.011 | 1.92 | 0.02 |

TABLE 2

| Production Conditions (Study of Composition) | | | | | | | | |
|---|---|---|---|---|---|---|---|---|
| Fin mat. no. | Alloy no. | Cast sheet thickness (mm) | I/A1 sheet thickness (mm) | I/A1 conditions | I/A2 sheet thickness (μm) | I/A2 conditions | Final cold rolling rate | Remarks |
| 1 | 1 | 7 | 3.5 | Batch furnace 300° C. × 2 hr | 75 | Batch furnace 400° C. × 2 hr | 20% | Inv. ex. |
| 2 | 2 | 7 | 3.5 | Batch furnace 300° C. × 2 hr | 75 | Batch furnace 400° C. × 2 hr | 20% | Inv. ex. |
| 3 | 3 | 7 | 3.5 | Batch furnace 300° C. × 2 hr | 86 | Batch furnace 400° C. × 2 hr | 30% | Inv. ex. |
| 4 | 4 | 7 | 3.5 | Batch furnace 300° C. × 2 hr | 75 | Batch furnace 400° C. × 2 hr | 20% | Inv. ex. |

TABLE 2-continued

| Production Conditions (Study of Composition) | | | | | | | | |
|---|---|---|---|---|---|---|---|---|
| Fin mat. no. | Alloy no. | Cast sheet thickness (mm) | I/A1 sheet thickness (mm) | I/A1 conditions | I/A2 sheet thickness (μm) | I/A2 conditions | Final cold rolling rate | Re-marks |
| 5 | 5 | 7 | 3.5 | Batch furnace 300° C. × 2 hr | 100 | Batch furnace 400° C. × 2 hr | 40% | Inv. ex. |
| 6 | 6 | 7 | 3.5 | Batch furnace 300° C. × 2 hr | 100 | Batch furnace 400° C. × 2 hr | 40% | Comp. ex. |
| 7 | 7 | 7 | 3.5 | | | | | Comp. ex. |
| 8 | 8 | 7 | 3.5 | Batch furnace 300° C. × 2 hr | 86 | Batch furnace 400° C. × 2 hr | 30% | Comp. ex. |
| 9 | 9 | 7 | 3.5 | Batch furnace 300° C. × 2 hr | 75 | Batch furnace 400° C. × 2 hr | 20% | Comp. ex. |
| 10 | 10 | 7 | 3.5 | | | | | Comp. ex. |
| 11 | 11 | 7 | 3.5 | Batch furnace 300° C. × 2 hr | 75 | Batch furnace 400° C. × 2 hr | 20% | Comp. ex. |
| 12 | 12 | 7 | 3.5 | Batch furnace 300° C. × 2 hr | 75 | Batch furnace 400° C. × 2 hr | 20% | Comp. ex. |
| 13 | 13 | 500 | 3.5 | Batch furnace 300° C. × 2 hr | 100 | Batch furnace 400° C. × 2 hr | 40% | Comp. ex. |
| 14 | 14 | 500 | 3.5 | Batch furnace 300° C. × 2 hr | 100 | Batch furnace 400° C. × 2 hr | 40% | Comp. ex. |

TABLE 3

| Production Conditions (Study of 2nd I/A Conditions) | | | | | | | | |
|---|---|---|---|---|---|---|---|---|
| Fin mat. no. | Alloy no. | Cast sheet thickness (mm) | I/A1 sheet thickness (mm) | I/A1 conditions | I/A2 sheet thickness (μm) | I/A2 conditions | Final cold rolling rate | Re-marks |
| 1 | 1 | 7 | 3.5 | Batch furnace 300° C. × 2 hr | 75 | Batch furnace 400° C. × 2 hr | 20% | Inv. ex. |
| 15 | 1 | 7 | 1.6 | Salt bath 450° C. × 15 s | 75 | Batch furnace 400° C. × 2 hr | 20% | Inv. ex. |
| 16 | 1 | 7 | 3.5 | Batch furnace 300° C. × 2 hr | 75 | Batch furnace 375° C. × 2 hr | 20% | Inv. ex. |
| 17 | 1 | 7 | 3.5 | Batch furnace 300° C. × 2 hr | 150 | Batch furnace 400° C. × 2 hr | 60% | Comp. ex. |
| 18 | 1 | 7 | 1.6 | Batch furnace 400° C. × 2 hr | 75 | Batch furnace 400° C. × 2 hr | 20% | Comp. ex. |
| 19 | 1 | 7 | 1.6 | Batch furnace 400° C. × 2 hr | 86 | Batch furnace 400° C. × 2 hr | 30% | Comp. ex. |
| 20 | 1 | 7 | 1.6 | Batch furnace 400° C. × 2 hr | 150 | Batch furnace 400° C. × 2 hr | 60% | Comp. ex. |
| 21 | 1 | 7 | 1.6 | Batch furnace 400° C. × 2 hr | 100 | Batch furnace 350° C. × 2 hr | 40% | Comp. ex. |
| 22 | 1 | 7 | 1.6 | Batch furnace 400° C. × 2 hr | 100 | Batch furnace 300° C. × 2 hr | 40% | Comp. ex. |
| 23 | 1 | 7 | 3.5 | Batch furnace 300° C. × 2 hr | 75 | Batch furnace 350° C. × 2 hr | 20% | Comp. ex. |
| 24 | 1 | 7 | 3.5 | Batch furnace 300° C. × 2 hr | 75 | Batch furnace 480° C. × 2 hr | 20% | Comp. ex. |
| 25 | 1 | 7 | 1.6 | Salt bath 450° C. × 15 s | 75 | Batch furnace 350° C. × 2 hr | 20% | Comp. ex. |

TABLE 4

| Production Conditions (Study of Final Annealing Conditions) | | | | | | | | | |
|---|---|---|---|---|---|---|---|---|---|
| Fin mat. no. | Alloy no. | Cast sheet thickness (mm) | I/A1 sheet thickness (mm) | I/A1 conditions | I/A2 sheet thickness (μm) | I/A2 conditions | Final cold rolling rate | Final annealing conditions | Remarks |
| 26 | 1 | 7 | 1.6 | Batch furnace 400° C. × 2 hr | 150 | Batch furnace 400° C. × 2 hr | 60% | 200° C. × 2 hr | Inv. ex. |
| 27 | 1 | 7 | 1.6 | Batch furnace 400° C. × 2 hr | 150 | Batch furnace 400° C. × 2 hr | 60% | 250° C. × 2 hr | Inv. ex. |
| 28 | 1 | 7 | 1.6 | Batch furnace 400° C. × 2 hr | 150 | Batch furnace 400° C. × 2 hr | 60% | 300° C. × 2 hr | Inv. ex. |
| 29 | 1 | 7 | 1.6 | Batch furnace 300° C. × 2 hr | 150 | Batch furnace 400° C. × 2 hr | 60% | 250° C. × 2 hr | Inv. ex. |
| 30 | 1 | 7 | 1.6 | Batch furnace 400° C. × 2 hr | 150 | Batch furnace 400° C. × 2 hr | 60% | 450° C. × 2 hr | Comp. ex. |
| 31 | 1 | 7 | 1.6 | Batch furnace 400° C. × 2 hr | 150 | Batch furnace 400° C. × 2 hr | 60% | 150° C. × 2 hr | Comp. ex. |

As comparative examples, alloys of the compositions of Alloy Nos. 13 and 14 shown in Table 1 were melted, cast by ordinary DC casting (thickness 500 mm, cooling rate at time of solidification of about 1° C./sec), surface ground, soaked, hot rolled, cold rolled (thickness 100 μm), intermediately annealed (400° C.×2 hr), and cold rolled to obtain fin materials of thicknesses of 60 μm. The obtained fin materials of the invention examples and comparative examples were measured by the following (1) to (4).

(1) Tensile Strength of Obtained Fin Material (MPa)

(2) Envisioning the brazing temperature, the materials were heated at 600 to 605° C. for 3.5 min, cooled, then measured for the following items:

[1] Tensile strength (MPa)

[2] Crystal grain size (μm) parallel to rolling direction by cutting method after electrolytically polishing surface to bring out crystal grain structure by
Barker Method

[3] Natural potential (mV) after immersion in 5% saline for 60 minutes using silver-silver chloride electrode as reference electrode

[4] Corrosion current density (μA/cm$^2$) found by cathode polarization performed in 5% saline by a potential sweep speed of 20 mV/min using a silver chloride-silver electrode as a reference electrode.

[5] Conductivity [% IACS] by conductivity test method described in JS-H0505

(3) Amount of sag (mm) using projection length of 50 mm by sag test method of LWS T 8801

(4) A fin material given a corrugated shape was placed on the surface of a brazing sheet coated with a noncorrosive fluoride-based flux and having a thickness of 0.25 mm (brazing material 4045 alloy clad rate 8%) (applied load 324 g), heated by a rate of temperature rise of 50° C./min to 605° C., and held there for 5 minutes. After cooling, the cross-section of the brazing was observed. Fin materials with light erosion at the crystal grain boundaries were evaluated as good ("G" marks) and fin materials with severe erosion and severe melting were evaluated as poor ("P" marks). Note that the corrugated shape was as follows:

Corrugated shape: Height 2.3 mm×width 21 mm×pitch 3.4 mm, 10 peaks

The results are shown in Tables 5 to 7.

TABLE 5

| Composition and Properties of Fin Materials (Study of Composition) | | | | | | | | | | | | | |
|---|---|---|---|---|---|---|---|---|---|---|---|---|---|
| | | | | H | After brazing heating | | | | | | | | |
| Fin mat. no. | Alloy no. | Recrystallization after I/A I/A1 | Recrystallization after I/A I/A2 | material Tensile strength (MPa) | Crystal grain size (μm) | Tensile strength (MPa) | Yield strength (MPa) | Conductivity (% IACS) | Natural potential (mv) | Sag resistance (project. 50) (mm) | Erosion resistance | Overall evaluation | Remarks |
| 1 | 1 | Not yet recryst. | Not yet recryst. | 222 | 5000 | 160 | 63 | 44.2 | −822 | 11.3 | G | G | Inv. ex. |
| 2 | 2 | Not yet recryst. | Not yet recryst. | 226 | 6700 | 158 | 61 | 42.8 | −834 | 12.7 | G | G | Inv. ex. |
| 3 | 3 | Not yet recryst. | Partially recryst. | 218 | 1800 | 156 | 61 | 43.8 | −832 | 10.7 | G | G | Inv. ex. |
| 4 | 4 | Not yet recryst. | Partially recryst. | 214 | 7700 | 153 | 61 | 43.5 | −826 | 9.9 | G | G | Inv. ex. |
| 5 | 5 | Not yet recryst. | Partially recryst. | 224 | 2700 | 150 | 60 | 44.4 | −826 | 14.2 | G | G | Inv. ex. |
| 6 | 6 | Not yet recryst. | Partially recryst. | 210 | 560 | 128 | 52 | 45.8 | −802 | 16.0 | G | P | Comp. ex. |
| 7 | 7 | Giant crystals formed during casting, cracking occurring during rolling | | | | | | | | | | P | Comp. ex. |
| 8 | 8 | Not yet recryst. | Not yet recryst. | 215 | 2200 | 132 | 41 | 42.8 | −804 | 15.5 | G | P | Comp. ex. |
| 9 | 9 | Not yet recryst. | Not yet recryst. | 255 | 2700 | 167 | 58 | 43.5 | −814 | 25.0 | P | P | Comp. ex. |

TABLE 5-continued

Composition and Properties of Fin Materials (Study of Composition)

| Fin mat. no. | Alloy no. | Recrystallization after I/A I/A1 | Recrystallization after I/A I/A2 | H material Tensile strength (MPa) | After brazing heating Crystal grain size (μm) | After brazing heating Tensile strength (MPa) | After brazing heating Yield strength (MPa) | After brazing heating Conductivity (% IACS) | After brazing heating Natural potential (mv) | After brazing heating Sag resistance (project. 50) (mm) | After brazing heating Erosion resistance | Overall evaluation | Remarks |
|---|---|---|---|---|---|---|---|---|---|---|---|---|---|
| 10 | 10 | Giant crystals formed during casting, cracking occurring during roiling | | | | | | | | | | P | Comp. ex. |
| 11 | 11 | Not yet recryst. | Not yet recryst. | 225 | 3200 | 154 | 58 | 42.3 | −730 | 16.0 | G | P | Comp. ex. |
| 12 | 12 | Not yet recryst. | Not yet recryst. | 229 | 3500 | 153 | 57 | 42.5 | −875 | 18.0 | P | P | Comp. ex. |
| 13 | 13 | Recryst. | Recryst. | 213 | 120 | 134 | 43 | 43.5 | −798 | 21.0 | P | P | Comp. ex. |
| 14 | 14 | Recryst. | Recryst. | 207 | 80 | 112 | 38 | 38.9 | −813 | 27.0 | P | P | Comp. ex. |

TABLE 6

Composition and Properties of Fin Materials (Study of Second I/A Conditions)

| Fin mat. no. | Alloy no. | Recrystallization after I/A I/A1 | Recrystallization after I/A I/A2 | H material Tensile strength (MPa) | After brazing heating Crystal grain size (μm) | After brazing heating Tensile strength (MPa) | After brazing heating Yield strength (MPa) | After brazing heating Sag resistance (projection 50) (mm) | After brazing heating Erosion resistance | Overall evaluation | Remarks |
|---|---|---|---|---|---|---|---|---|---|---|---|
| 1 | 1 | Not yet recrystallized | Not yet recrystallized | 222 | 5000 | 160 | 63 | 11.3 | G | G | Inv. ex. |
| 15 | 1 | Not yet recrystallized | Not yet recrystallized | 222 | 5500 | 160 | 63 | 8.2 | G | G | Inv. ex. |
| 16 | 1 | Not yet recrystallized | Not yet recrystallized | 223 | 5800 | 155 | 61 | 12.8 | G | G | Inv. ex. |
| 17 | 1 | Not yet recrystallized | Not yet recrystallized | 253 | 1700 | 165 | 65 | 16.0 | G | P | Comp. ex. |
| 18 | 1 | Not yet recrystallized | Recrystallized | 200 | Not yet recrystallized | 168 | 83 | 33.3 | P | P | Comp. ex. |
| 19 | 1 | Not yet recrystallized | Recrystallized | 216 | Not yet recrystallized | 160 | 66 | 33.4 | P | P | Comp. ex. |
| 20 | 1 | Not yet recrystallized | Not yet recrystallized | 247 | 330 | 165 | 65 | 19.5 | P | P | Comp. ex. |
| 21 | 1 | Not yet recrystallized | Not yet recrystallized | 248 | 1100 | 166 | 66 | 6.8 | G | P | Comp. ex. |
| 22 | 1 | Hot yet recrystallized | Not yet recrystallized | 254 | 1200 | 166 | 67 | 8.5 | G | P | Comp. ex. |
| 23 | 1 | Not yet recrystallized | Not yet recrystallized | 245 | 2600 | 165 | 65 | 24.2 | G | P | Comp. ex. |
| 24 | 1 | Not yet recrystallized | Recrystallized | 198 | Not yet recrystallized | 165 | 65 | 32.0 | P | P | Comp. ex. |
| 25 | 1 | Not yet recrystallized | Not yet recrystallized | 243 | 3200 | 165 | 66 | 16.4 | G | P | Comp. ex. |

TABLE 7

Composition and Properties of Fin Materials (Study of Final Annealing Conditions)

| Fin mat. no. | Alloy no. | Recrystallization after I/A I/A1 | Recrystallization after I/A I/A2 | After final annealing I/A1 | H material Tensile strength (MPa) | After brazing heating Crystal grain size (μm) | After brazing heating Tensile strength (MPa) | After brazing heating Yield strength (MPa) | After brazing heating Sag resistance (projection 50) (mm) | After brazing heating Erosion resistance | Overall evaluation | Remarks |
|---|---|---|---|---|---|---|---|---|---|---|---|---|
| 26 | 1 | Not yet recrystallized | Not yet recrystallized | Not yet recrystallized | 230 | 540 | 157 | 62 | 13.2 | G | G | Inv. ex. |
| 27 | 1 | Not yet recrystallized | Not yet recrystallized | Not yet recrystallized | 226 | 800 | 155 | 58 | 11.8 | G | G | Inv. ex. |
| 28 | 1 | Not yet recrystallized | Not yet recrystallized | Not yet recrystallized | 175 | 1200 | 153 | 59 | 10.6 | G | G | Inv. ex. |

TABLE 7-continued

Composition and Properties of Fin Materials (Study of Final Annealing Conditions)

| Fin mat. no. | Alloy no. | Recrystallization after I/A I/A1 | Recrystallization after I/A I/A2 | After final annealing I/A1 | H material Tensile strength (MPa) | H Crystal grain size (μm) | After brazing heating Tensile strength (MPa) | After brazing heating Yield strength (MPa) | After brazing heating Sag resistance (projection 50) (mm) | After brazing heating Erosion resistance | After brazing heating Overall evaluation | Remarks |
|---|---|---|---|---|---|---|---|---|---|---|---|---|
| 29 | 1 | Not yet recrystallized | Not yet recrystallized | Not yet recrystallized | 228 | 1000 | 156 | 59 | 10.8 | G | G | Inv. ex. |
| 30 | 1 | Not yet recrystallized | Not yet recrystallized | Recrystallized | 150 | 1500 | 153 | 62 | 3.5 | P | P | Comp. ex. |
| 31 | 1 | Not yet recrystallized | Not yet recrystallized | Not yet recrystallized | 247 | 360 | 160 | 65 | 12.0 | P | P | Comp. ex. |

From the results of Table 5, it is learned that the fin materials according to the present invention (Fin Material Nos. 1 to 5) were excellent in all of tensile strength after brazing, erosion resistance, sag resistance, sacrificial anodization effect, and self corrosion resistance. Fin Material No. 6 of the comparative example was low in Mn content and low in tensile strength after brazing. Fin Material No. 7 of the comparative example was high in Mn content, had giant crystals formed at the time of casting, cracked during cold rolling, and could not give a fin material. Fin Material No. 8 of the comparative example was low in Si content and was low in tensile strength after brazing. Fin Material No. 9 of the comparative example was high in Si content and inferior in erosion resistance. Fin Material No. 10 of the comparative example was high in Fe content, had giant crystals formed at the time of casting, cracked during cold rolling, and could not give a fin material.

Fin Material No. 11 of the comparative example was low in Zn content, cathodic in natural potential, and inferior in sacrificial anodization effect. Fin Material No. 12, of the comparative example was high in Zn content, inferior in self corrosion resistance, and inferior in erosion resistance as well. The low Mn content Fin Material No. 13 of the comparative example and the low Si, Mn content Fin Material No, 14 of the comparative example obtained by ordinary DC casting (thickness 500 mm, cooling rate at time of solidification of about 1° C./sec), surface grinding, soaking, hot rolling, cold rolling (thickness 100 μm), intermediate annealing (400° C.×2 hr), and cold rolling had low tensile strengths after brazing, had small crystal grain sizes after brazing, and were inferior in sag resistance and erosion resistance.

From the results of Table 6, it is learned that the fin materials according to the present invention (Fin Material Nos. 1, 15, and 16) all had tensile strengths before brazing of not more than 240 MPa, were excellent in formability, and were excellent in tensile strength after brazing, erosion resistance, and sag resistance. Fin Material No. 17 of the comparative example had a final cold rolling rate of 60%, so was high in tensile strength before brazing and inferior in formability. Fin Material Nos. 18 and 19 of the comparative examples had high temperatures of the primary intermediate annealing, so had structures after brazing which did not recrystallize and were inferior in sag resistance and erosion resistance. Fin Material No. 20 of the comparative example had a final cold rolling rate of 60%, so was high in tensile strength before brazing and was inferior in erosion resistance. Fin Material Nos. 21 and 22 of the comparative example had low temperatures of the secondary intermediate annealing, so were high in tensile strength before brazing and inferior in formability. Fin Material Nos. 23 and 25 of the comparative examples had low temperatures of the secondary annealing, so were high in tensile strength before brazing and inferior in formability. Fin Material No. 24 of the comparative example had a high temperature of secondary intermediate annealing, so ended up recrystallizing and was inferior in erosion resistance.

From the results of Table 7, it is learned that the fin materials according to the present invention (Fin Material Nos. 26 to 29) all had tensile strengths before brazing of not more than 240 MPa, were excellent in formability, and were excellent in tensile strength after brazing, erosion resistance, and sag resistance. Fin Material No. 30 of the comparative example had a high temperature of final annealing, so ended up recrystallizing and was inferior in erosion resistance. Fin Material No. 31 of the comparative example had a low temperature of the final annealing, so was high in tensile strength before brazing and inferior in formability.

INDUSTRIAL APPLICABILITY

According to the present invention, there are provided a heat exchanger use aluminum alloy fin material having suitable strength before brazing enabling easy fin forming, having high strength after brazing as well, and having excellent sag resistance, erosion resistance, self corrosion resistance, and sacrificial anodization and a method of production of the same.

The invention claimed is:

1. A heat exchanger use thermally conductive, erosion resistant, sag resistant, self-corrosion resistant high strength aluminum alloy fin material having sacrificial anodization effect, comprising Si: 0.8 to 1.4 wt %, Fe: 0.45 to 0.7 wt %, Mn: 1.5 to 3.0 wt %, and Zn: 0.5 to 2.5 wt %, limiting the Mg as an impurity to 0.05 wt % or less, limiting the Cu as an impurity to 0.02 wt % or less, and having a balance of ordinary impurities and Al in chemical composition, having a metal structure before brazing of a fibrous crystal grain structure, a tensile strength before brazing of not more than 240 MPa, a tensile strength after brazing of not less than 150 MPa, and a recrystallized grain size after brazing of 1800 μm or more.

2. A heat exchanger use thermally conductive, erosion resistant, sag resistant, self-corrosion resistant high strength aluminum alloy fin material having sacrificial anodization effect, comprising Si: 0.8 to 1.4 wt %, Fe: 0.45 to 0.7 wt %, Mn: 1.5 to 3.0 wt %, and Zn: 0.5 to 2.5 wt %, limiting the Mg as an impurity to 0.05 wt % or less, limiting the Cu as an impurity to 0.02 wt % or less, and having a balance of ordinary impurities and Al in chemical composition, having a metal structure before brazing of a non-recrystallized fibrous grain structure, a tensile strength before brazing of not more than 240 MPa, a tensile strength after brazing of not less than 150 MPa, and a recrystallized grain size after brazing of 5000 μm or more.

3. A heat exchanger use thermally conductive, erosion resistant, sag resistant, self-corrosion resistant high strength aluminum alloy fin material having sacrificial anodization effect, comprising:

0.8-1.4 wt % of Si, 0.45-0.7 wt % of Fe, 2.2-3.0 wt % of Mn, and 0.5-2.5 wt % of Zn, limiting the Mg as an impurity to 0.05 wt % or less, limiting the total content of Cr, Zr, Ti, and V as impurities to 0.20 wt % or less, and having a balance of ordinary impurities and Al in chemical composition, having a metal structure before brazing of a fibrous crystal grain structure, a tensile strength before brazing of not more than 250 MPa, a tensile strength after brazing of not less than 150 MPa, and a recrystallized grain size after brazing of 500 μm or more.

4. A heat exchanger use thermally conductive, erosion resistant, sag resistant, self-corrosion resistant high strength aluminum alloy fin material having sacrificial anodization effect, comprising:

0.8-1.4 wt % of Si, 0.45-0.7 wt % of Fe, 2.2-3.0 wt % of Mn, and 0.5-2.5 wt % of Zn, limiting the Mg as an impurity to 0.05 wt % or less, limiting the total content of Cr, Zr, Ti, and V as impurities to 0.20 wt % or less, and having a balance of ordinary impurities and Al in chemical composition, having a metal structure before brazing of a non-crystallized fibrous grain structure, a tensile strength before brazing of not more than 240 MPa, a tensile strength after brazing of not less than 150 MPa, and a recrystallized grain size after brazing of 500 μm or more.

* * * * *

UNITED STATES PATENT AND TRADEMARK OFFICE

CERTIFICATE OF CORRECTION

PATENT NO. : 8,226,781 B2
APPLICATION NO. : 13/207950
DATED : July 24, 2012
INVENTOR(S) : Suzuki et al.

It is certified that error appears in the above-identified patent and that said Letters Patent is hereby corrected as shown below:

In the Claims

Claim 2, Column 17, line 2, reads "150 MPa, and a recrystallized grain size after brazing of 5000" should read -- 150 MPa, and a recrystallized grain size after brazing of 500 --

Signed and Sealed this
Ninth Day of July, 2013

Teresa Stanek Rea
*Acting Director of the United States Patent and Trademark Office*